US006152770A

United States Patent [19]

Wang

[11] Patent Number: 6,152,770

[45] Date of Patent: Nov. 28, 2000

[54] WATER-PROOF SOCKET ADAPTER DESIGN

[76] Inventor: Lien-Sheng Wang, No. 27, 8th Floor-2, Alley 3, Lane 318, 2nd Section, Chong-Sing Rd., Chu-Dong, Taiwan

[21] Appl. No.: 09/276,904

[22] Filed: Mar. 26, 1999

[51] Int. Cl.[7] ..... H01R 13/40

[52] U.S. Cl. ..... 439/598; 439/934

[58] Field of Search ..... 439/598, 934, 439/686, 460, 465, 695

[56] References Cited

U.S. PATENT DOCUMENTS

| | | | |
|---|---|---|---|
| 3,166,371 | 1/1965 | Brown et al. | 339/60 |
| 4,846,723 | 7/1989 | Pong | 439/456 |
| 5,046,969 | 9/1991 | Liao | 439/686 |
| 5,154,642 | 10/1992 | Chung-Yin | 439/622 |
| 5,336,114 | 8/1994 | Wang | 439/598 |
| 5,707,255 | 1/1998 | Lu | 439/686 |

*Primary Examiner*—Michael L. Gellner
*Assistant Examiner*—Kyung S. Lee
*Attorney, Agent, or Firm*—Rabin & Champagne, P.C.

[57] ABSTRACT

An improved water-proof socket adapter design includes an insert holder, a housing, a power cable and leaf copper conductors, the insert holder has a waterproof partition in it and an extension at its end on which a division, cord grooves, sliding blocks and ribs are provided, when a power cable with leaf copper conductors is placed in the insert holder, outer insulators of the power cable will rest against the ribs, and will be clamped by ribs in the cord grooves of the housing when the insert holder is inserted into the housing, therefore, the power cable is fixed firmly in the cord grooves with its cords being separated by the division; the housing has guide slots, key ways and sliding slots provided in it, when the insert holder is inserted into the housing, its waterproof partition and the division and the sliding blocks on the extension are fitted just in the guide slots and the sliding slots respectively, therefore, the cords of the power cable may be separated positively without any short circuit providing functions of waterproof protection, electrical leakage/short circuit prevention, tension/shock resistance and secure electrical connection.

8 Claims, 7 Drawing Sheets

WATER-PROOF SOCKET ADAPTER DESIGN

FIELD OF THE INVENTION

The present invention relates to an improved waterproof socket adapter design, especially a design, which is able to provide a positively secure electrical connection, tension/shock resistance, waterproof protection and electrical leakage prevention.

BACKGROUND OF THE INVENTION

A conventional socket adapter is shown in FIG. 1 (Schematic Exploded View of a Conventional Socket Adapter) in which an insert holder 11 has two receptacles 111 at proper points for containing leaf copper conductors 21 of a power cable 20 connected to a power source. The receptacles 111 are separated by a separator 114. The insert holder 11 has plug-holes 112 on its front side and a passage 113 arranged for cords going through. When the leaf copper conductors 21 of the power cable 20 are fitted in the insert holder 11 which, then, is inserted in an exposed internal space 121 of a housing 12, a complete socket adapter will be obtained. However, such a socket adapter design has some shortcomings such as unsatisfactory waterproof protection, presence of a potential risk of short circuit caused by loose cords of the power cable 20 if the joint 22 between the power cable 20 and the leaf copper conductors 21 is not clamped properly. Furthermore, the clamped joint 22 of the power cable 20, after long term use, may be loosened or unclamped by an eventual foreign force, resulting in a power failure or electrical leakage, or damaged by undesired shocks. Therefore, it is really not an ideal design.

So, a socket adapter design is desired which is able to provide waterproof protection, high strength and excellent security.

SUMMARY OF THE INVENTION

An object of the present invention is to provide an improved waterproof socket adapter design, especially a design which is able to offer a positively secure electrical connection, tension/shock resistance, waterproof protection and electrical leakage prevention.

However, in order to describe the object, characteristics and functions of the present invention, an example of an embodiment and relative figures to the present invention are given as following:

DETAILED DESCRIPTION OF THE INVENTION

Figure 1:
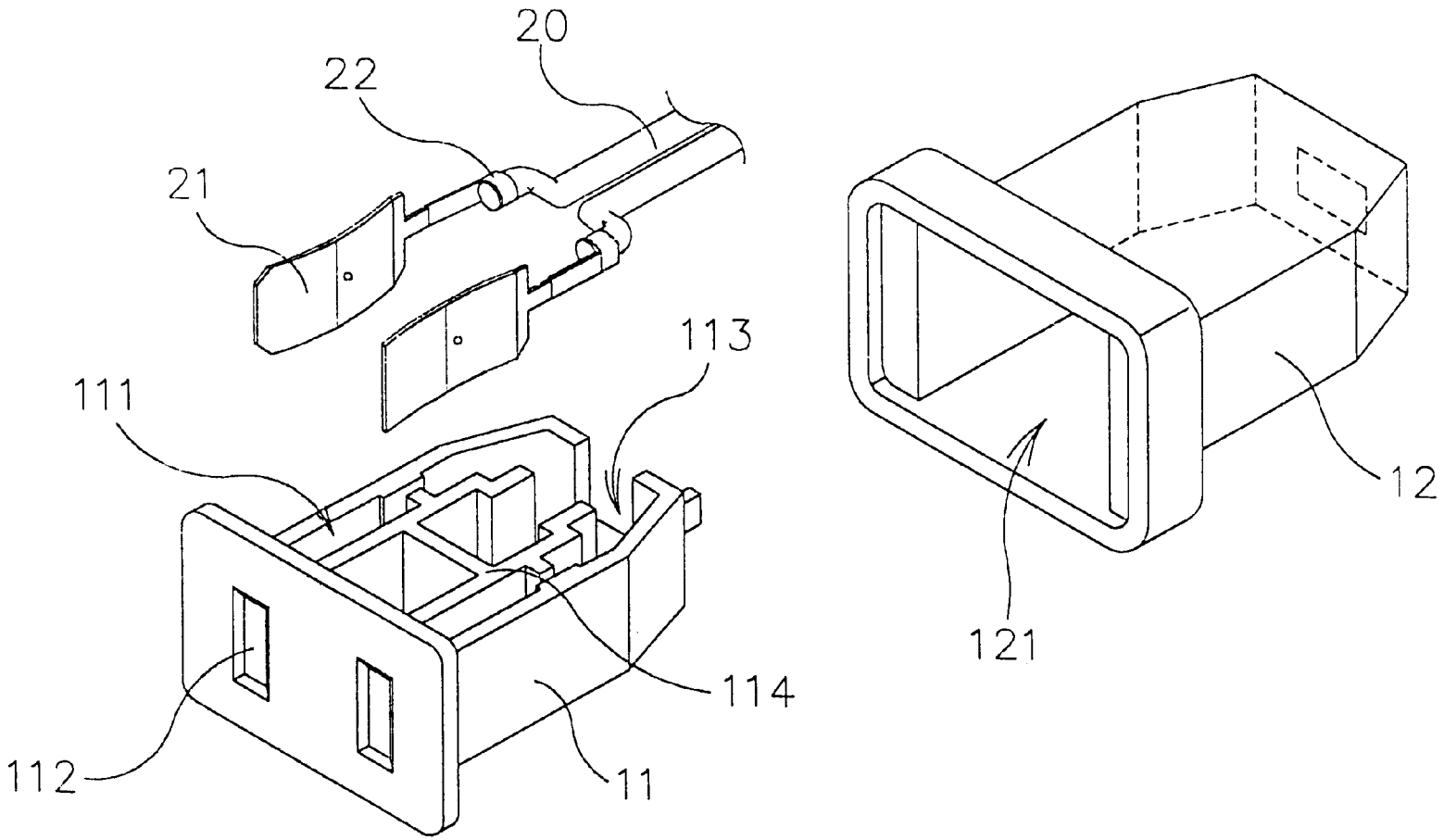
Fig. 1 PRIOR ART
FIG. 1 is a schematic exploded view of a conventional socket adapter design.
Figure 2:
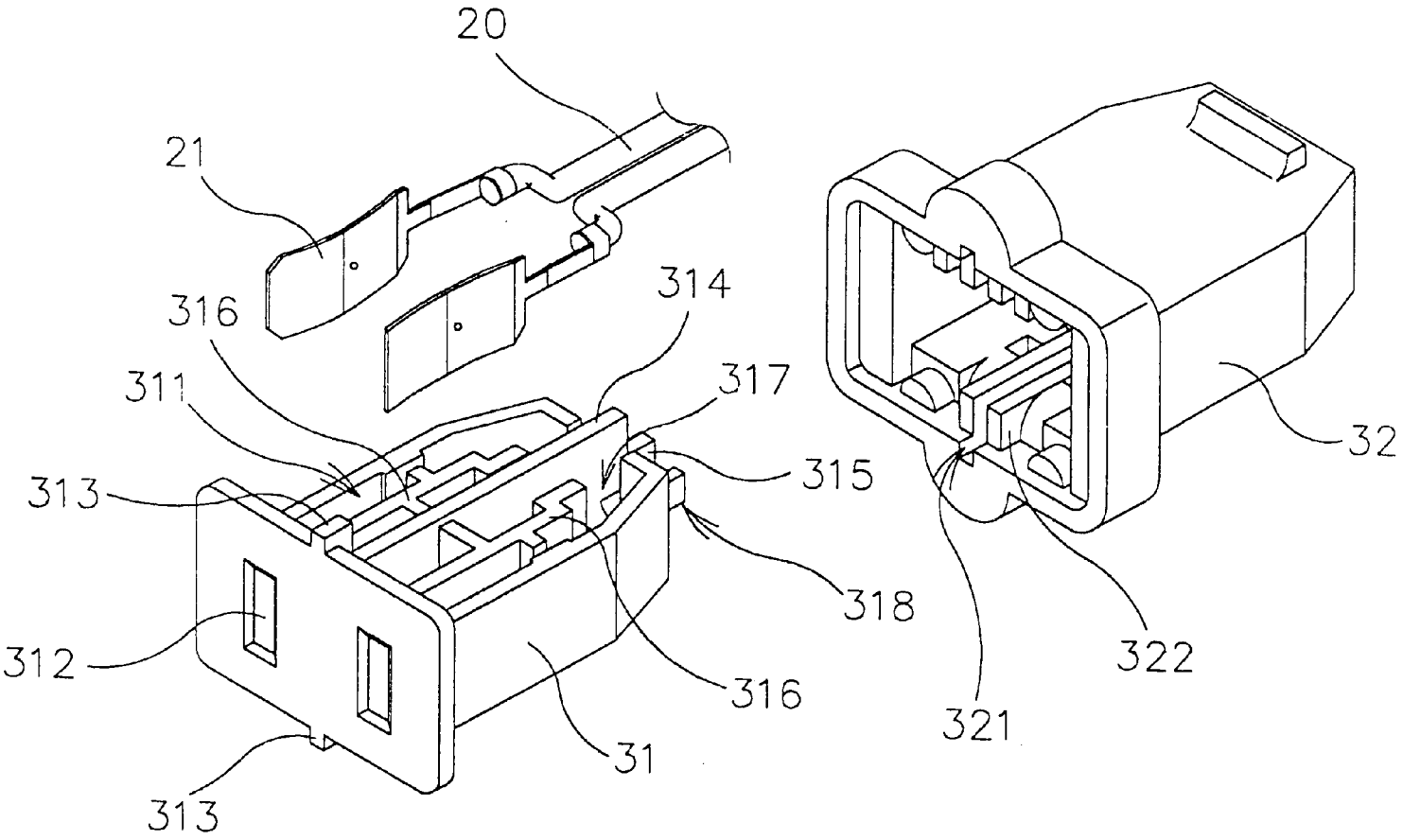
FIG. 2 is a schematic exploded view of the present invention.
Figure 3:
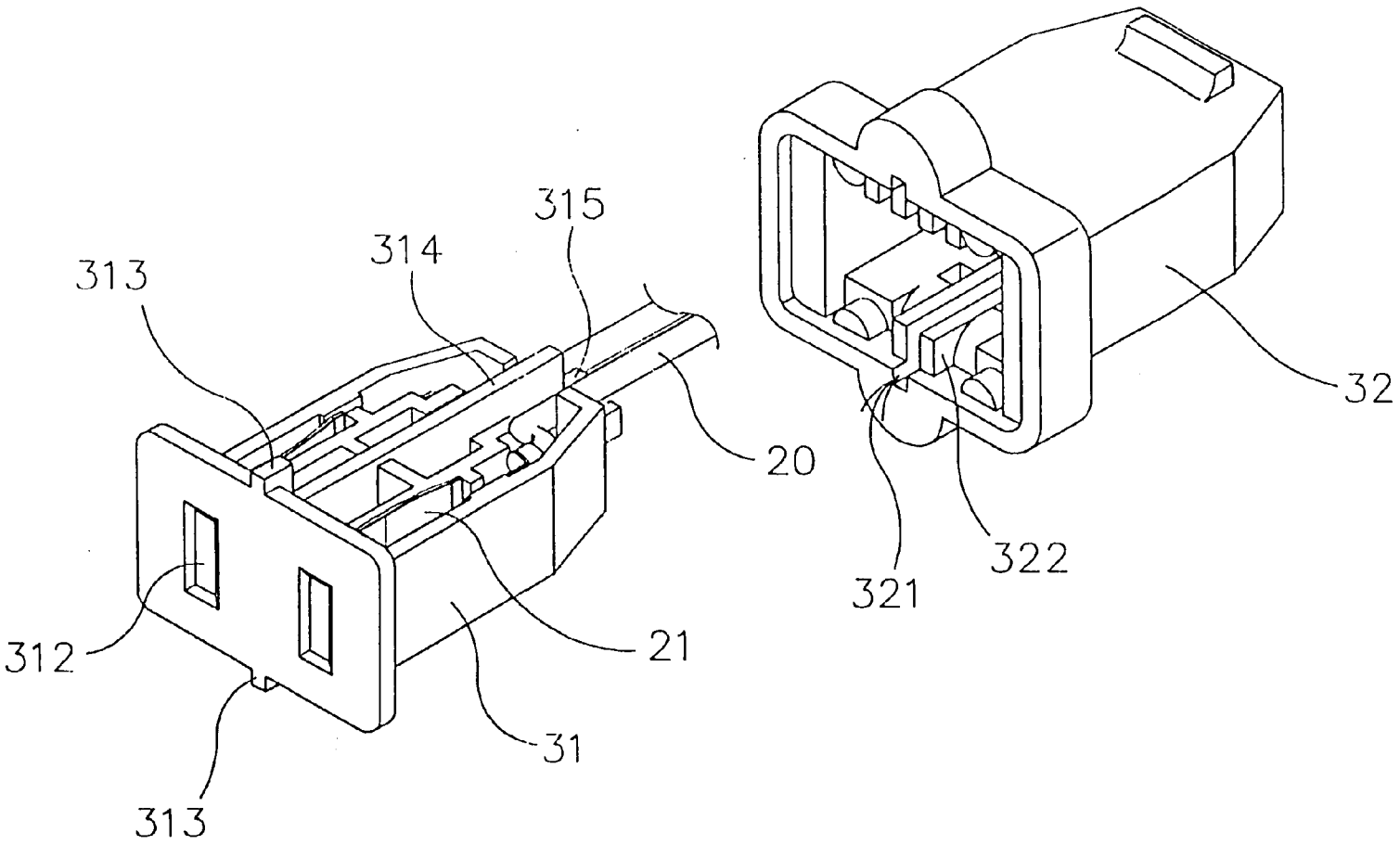
FIG. 3 is a schematic assembly view of the present invention.

FIG. 2 is a schematic exploded view of the present invention and FIG. 3 is a schematic assembly view of the present invention, in which an insert holder 31, a housing 32, a power cable 20 and leaf copper conductors 21 are included. The insert holder 31 has two receptacles 311 provided at proper points in it for containing the leaf copper conductors 21 of the power cable 20 (which is connected to a power source), and the receptacles 311 are separated by two separators 316. At a proper point between the two separators 316, a waterproof partition 314 is arranged just at the central position between the two separators 316. The insert holder 31 has plug-holes 312 on its front side and two passages 317 for cords going through. Furthermore, on the central line between the two plug-holes 312, the insert holder 31 has keys 313 provided respectively on the front upper and lower edges, and an extension 318 with a division 315 for the separation of the cords of the power cable 20 is arranged along the edge of the passage 317 of the rear side of the insert holder 31. Cord grooves 319 are provided beside the division 315 respectively so that the power cable will be clamped firmly without being loosened due to an eventual foreign force. Consequently, potential risks of a power failure, electrical leakage or a short circuit will be eliminated.

The housing 32 has an open side. On the upper and the lower insides of the housing 32 keyways 321 and guide slots 322 are arranged. When the power cable 20 with the leaf copper conductors 21 is placed in the insert holder 31 (as shown in FIG. 3) which, then is inserted into the housing 32, the waterproof partition 314 will be fitted in the upper and lower guide slots 322 in the housing 32 respectively. Meanwhile, the insert holder 31 may be pushed to the internal extreme position in the housing 32 so that the keys 313 on the front side of the insert holder 31 will be just fitted in the keyways 321 in the housing 32.

Figure 4B:
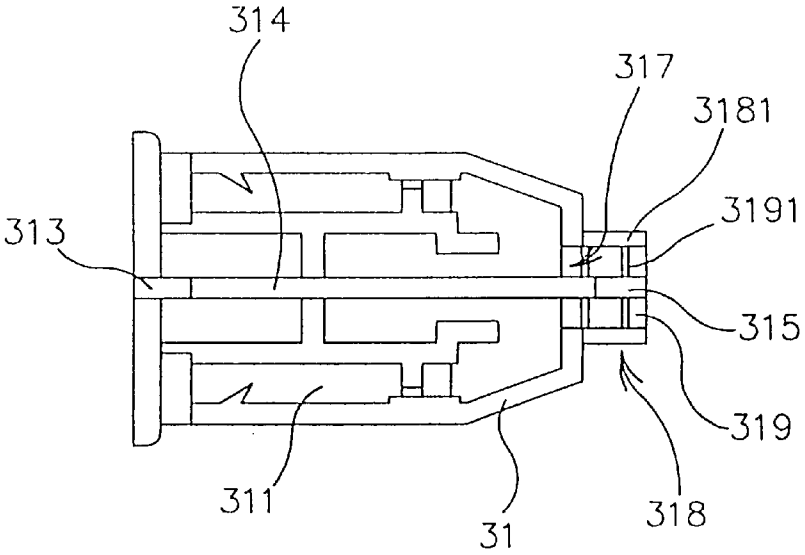
FIGS. 4A and 4B are schematic upward views of an insert holder of the present invention.
Figure 5:
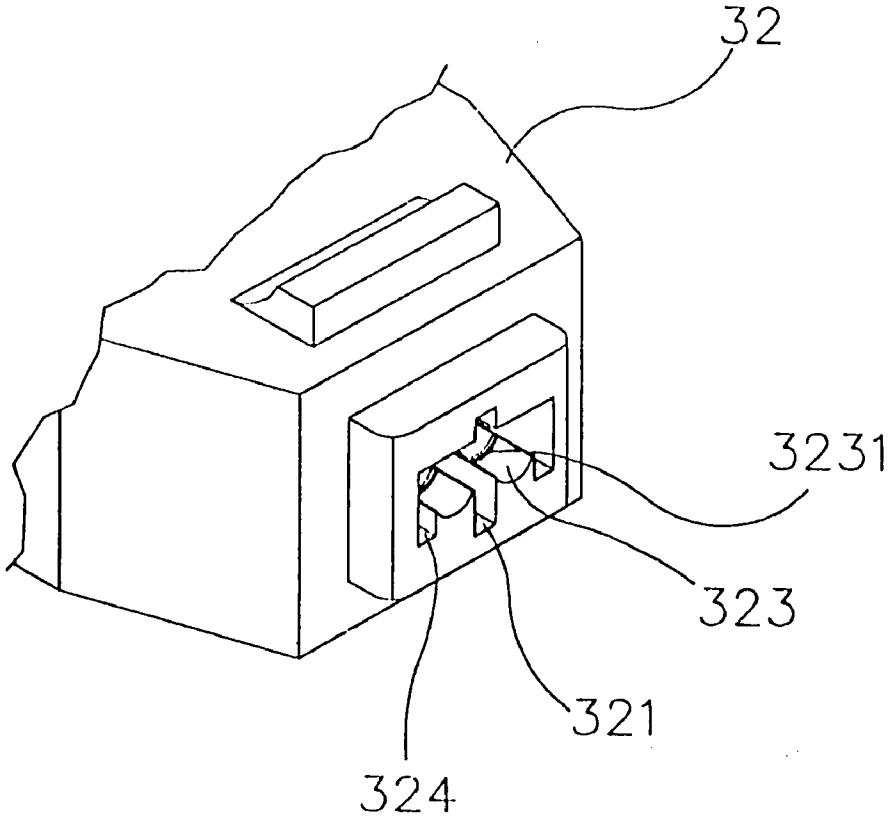
FIG. 5 is a schematic vertical view of an insert holder of the present invention.
Figure 6B:
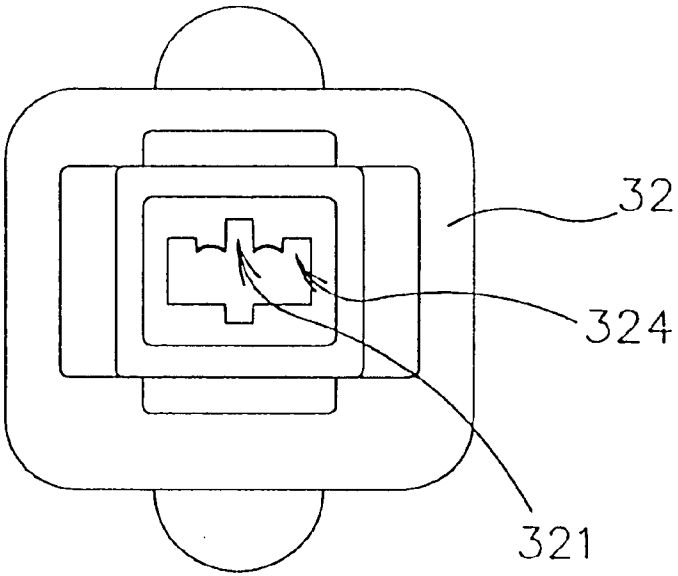
FIG. 6B is a schematic rear view of a housing of the present invention.
Figure 6A:
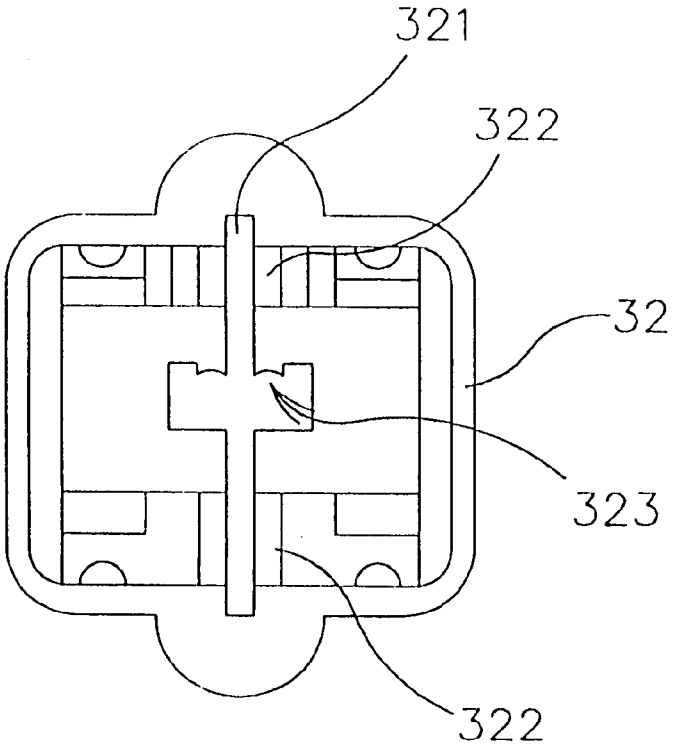
FIG. 6A is a schematic front view of a housing of the present invention.
Figure 7:
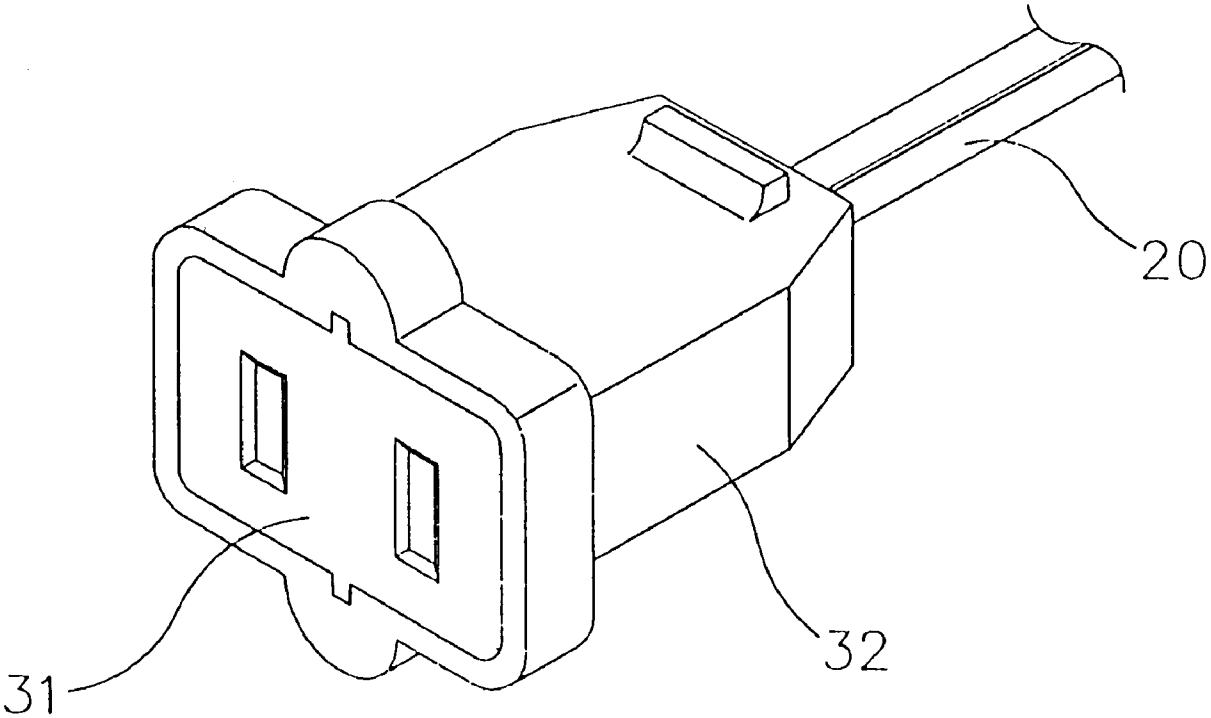
FIG. 7 is a schematic assembly view of the present invention.

When the power cable 20 is placed in the insert holder 31, its cords are rested against the ribs 3191 provided in the cord grooves 319 (as shown in FIG. 4B). When the housing 32 is placed onto it, the power cable 20 in the cord grooves 319 will be pushed to the bottom of the housing 32 and on the ribs 3231 in the cord grooves 323 (as shown in FIG. 5 and FIG. 6), so that the power cable 21 is clamped firmly between the ribs 3191 and 3231 without being loose or removable. At that time a socket adapter assembly is obtained, as shown in FIG. 7.

Figure 4A:
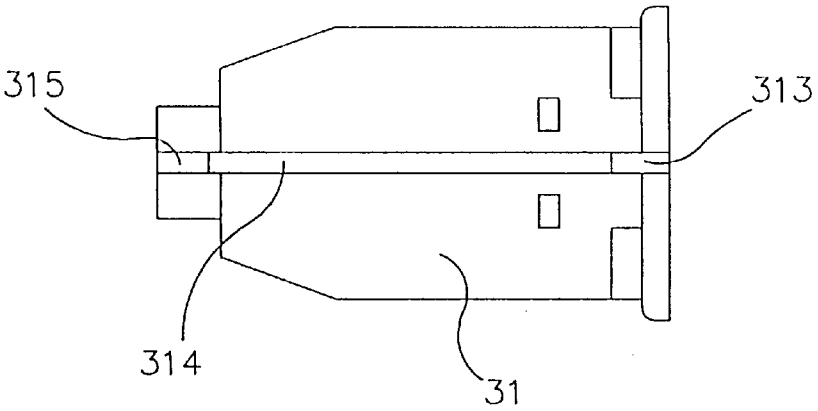

The waterproof partition 314 extends from a top side to a bottom side in the insert holder 31 (as shown in FIG. 4). When it fits in the guide slots 322 in the housing 32, the two cords of the power cable 20 are completely separated. That is, even if a poor joint is present between the wires of the power cable 20 and the leaf copper conductors 21 causing exposed wires, there will be no possibility of the conductors 21 contacting each other resulting in a short circuit. Therefore, the occurrence of a short circuit in power line will be avoided positively. The extension 318 has sliding blocks 3181 on both side edges which are fitted just in the sliding slots 324 in the housing 32. Further, the outer insulators of the power cable 20 are clamped between the ribs 3191 on the extension 318 and the ribs 3231 in the housing 32, so, the power cable 20 will be fixed firmly without being loosened or removed by an eventual foreign force. The cord grooves 319 and 323 further have a profiled design providing a waterproof function. Because the power cable 20 is placed in the assembled insert holder and housing, the outer insulators of the power cable 20 will be clawed between the ribs 3191 and 3231; consequently, functions airtight, shock resistant and waterproof will be presented, therefore, it is really an excellent design.

As seen according to the above, the present invention Improved Waterproof Socket Adapter Design has really the practical applicability and the creativeness, and has never been published to the public, that conforms to the regulations specified in the Patent Law.

The embodiment mentioned above is only a better example to embody the present invention, and can not restrict the range of embodiment of the present invention to it. Any modification or change made based on the present invention shall be considered to be within coverage of the present invention.

What is claimed is:

1. An improved waterproof socket adapter, comprising:

an insert holder having a front end with plug holes, and having a waterproof partition therein, said insert holder further having an extension at a rear end thereof, the extension having a division, a first set of cord grooves separated by the division, and ribs within the first set of cord grooves;

a housing adapted to receive said insert holder therein, and having guide slots arranged therein and in registration with the waterproof partition for guiding and accommodating the waterproof partition when said housing and said insert holder are assembled together, said housing further including a second set of cord grooves and ribs within the second set of cord grooves;

a power cable having at least two cords positively separated from each other by said waterproof partition when said housing and said insert holder are assembled together, said power cable further having an outer insulator; and leaf copper conductors connected to respective ends of the at least two cords and being disposed within said insert holder;

wherein when said power cable with leaf copper conductors is in the insert holder, and said housing and said insert holder are assembled together, the outer insulator rests against the ribs within the first set of cord grooves and is clamped by the ribs within the first set of cord grooves and by the ribs within the second set of cord grooves in a water tight connection, thereby firmly fixing the power cable between the respective ribs.

2. An improved waterproof socket adapter design according to claim 1, in which the housing has keyways arranged on its upper and lower insides.

3. An improved waterproof socket adapter design according to claim 2, in which the insert holder has keys provided respectively on its front upper and lower edges which are fitted in the keyways in the housing.

4. An improved waterproof socket adapter design according to claim 1, in which the insert holder has keys provided respectively on its front upper and lower edges which are fitted in the keyways in the housing.

5. An improved waterproof socket adapter design according to claim 1, in which the housing has sliding slots arranged on the bottom side in it.

6. An improved waterproof socket adapter design according to claim 5, in which the extension has sliding blocks provided on it which are fitted in the sliding slots in the housing.

7. An improved waterproof socket adapter design according to claim 1, in which the extension has sliding blocks provided on it which are fitted in the sliding slots in the housing.

8. An improved waterproof socket adapter design according to claim 1, in which the insert holder has the waterproof partition extending from a top side to a bottom side thereof.

* * * * *